US008495984B2

(12) United States Patent
Riegel et al.

(10) Patent No.: US 8,495,984 B2
(45) Date of Patent: Jul. 30, 2013

(54) SPARK VOLTAGE LIMITING SYSTEM FOR ACTIVE FUEL MANAGEMENT

(75) Inventors: Robert W. Riegel, Shelby Township, MI (US); Yujiro Suwa, Commerce Township, MI (US); Ronald M. Wozniak, Auburn Hills, MI (US); Anthony L. Marks, Novi, MI (US)

(73) Assignee: GM Global Technology Operations LLC

( * ) Notice: Subject to any disclaimer, the term of this patent is extended or adjusted under 35 U.S.C. 154(b) by 947 days.

(21) Appl. No.: 12/605,720

(22) Filed: Oct. 26, 2009

(65) Prior Publication Data

US 2011/0094475 A1 Apr. 28, 2011

(51) Int. Cl.

| | |
|---|---|
| ***F02P 5/00*** | (2006.01) |
| ***F02D 7/00*** | (2006.01) |
| ***F02D 13/06*** | (2006.01) |
| ***F02D 17/04*** | (2006.01) |
| ***F02D 17/02*** | (2006.01) |

(52) U.S. Cl.

USPC ..... 123/406.23; 123/406.2; 123/481; 123/198 F; 123/406.47; 123/198 DC; 123/198 DB

(58) Field of Classification Search

USPC ..... 123/198 F, 198 DB, 480, 481, 406.12, 123/406.11, 406.13, 406.2, 406.23, 406.26, 123/406.27, 406.3, 406.29, 406.39, 406.45, 123/406.47, 406.6, 626

See application file for complete search history.

(56) References Cited

U.S. PATENT DOCUMENTS 4,364,343 A * 12/1982 Malik ..... 123/179.4
2006/0207569 A1 * 9/2006 Winstead et al. ..... 123/479

FOREIGN PATENT DOCUMENTS

JP 60-169672 * 9/1985

* cited by examiner

*Primary Examiner* — Stephen K Cronin
*Assistant Examiner* — Raza Najmuddin

(57) ABSTRACT

An engine control system for a vehicle includes a variable displacement module that deactivates N of M cylinders of an engine during a fuel management mode. N is an integer and M is an integer greater than 1. A spark control module generates a spark timing signal for the N cylinders based on a pre-dwell time and a fuel management dwell modifier during the fuel management mode. The spark control module reduces dwell time of the N cylinders during the fuel management mode based on the fuel management dwell modifier.

20 Claims, 6 Drawing Sheets

SPARK VOLTAGE LIMITING SYSTEM FOR ACTIVE FUEL MANAGEMENT

FIELD

The present disclosure relates to ignition and fuel control systems, and more particularly to spark during active fuel management.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Active Fuel Management™ (AFM) or variable displacement allows displacement of an internal combustion engine (ICE) to change by deactivation of one or more cylinders. Deactivation of cylinder(s) improves fuel economy of a vehicle. During light-load conditions, an AFM mode may be enabled to deactivate cylinders of an engine. The deactivated cylinders may be reactivated during heavy-load conditions. As an example, during an AFM mode, activated cylinders on a V8 engine may be reduced to 4. As another example, during an AFM mode, activated cylinders on a V6 engine may be reduced to 3.

During an AFM mode, fuel is not provided to deactivated cylinders. Also, intake and exhaust valves of the deactivated cylinders are maintained in a closed state. This prevents air and fuel from entering the combustion chambers of the deactivated cylinders and prevents contents of the combustion chambers from exiting the deactivated cylinders. The deactivated cylinders perform as air shocks during the AFM mode.

Since the exhaust valves of the deactivated cylinders do not open during the AFM mode, oil on the cylinder walls can build up in the combustion chambers. Although pistons in the cylinders include oil rings that are used to prevent oil from entering the combustion chambers, the oil rings do not completely remove all of the oil on the cylinder walls. This oil may form a mist in the combustion chambers and build up over multiple combustion cycles.

The oil can build up, for example, between electrodes of spark plugs. Since oil performs as an insulator, spark that is created by a spark plug may jump between a first electrode (e.g. side electrode) and an insulator (e.g. ceramic material) surrounding a second electrode (e.g. center electrode) of the spark plug. This causes holes in the insulator on the second electrode and results in abrasive debris in a combustion chamber, which can scratch cylinder walls. The debris can cause premature piston ring and cylinder bore wear, which can lead to increased oil consumption.

SUMMARY

An engine control system for a vehicle is provided that includes a variable displacement module that deactivates N of M cylinders of an engine during a fuel management mode. N is an integer and M is an integer greater than 1. A spark control module generates a spark timing signal for the N cylinders based on a pre-dwell time and a fuel management dwell modifier during the fuel management mode. The spark control module reduces dwell time of the N cylinders during the fuel management mode based on the fuel management dwell modifier.

In other features, an engine control system for a vehicle is provided and includes a variable displacement module that deactivates N of M cylinders of an engine during a fuel management mode. A spark control module generates a spark timing signal for the N cylinders. An ignition coil circuit limits at least one of a current level of a coil of a spark plug of the N cylinders to a predetermined current level and a secondary voltage of the spark plug to a predetermined voltage level during the fuel management mode.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
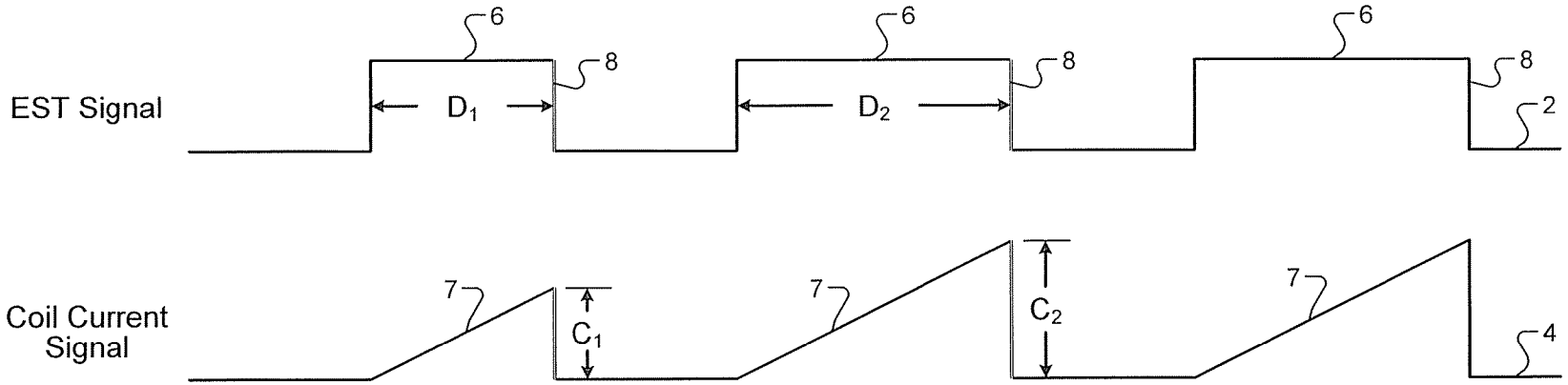
FIG. 1 is an exemplary plot of an electronic spark timing signal and a corresponding coil current signal.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

In the following description, the terms dwell, dwell time and dwell period may refer to the amount of time that current is supplied to coil(s) of spark plug(s) of an engine. In FIG. 1, a plot of an electronic spark timing (EST) signal 2 and a corresponding coil current signal 4 is shown. The EST signal 2, as shown, includes current supply pulses 6 with respective dwell periods (dwell periods $D_1$ and $D_2$ are identified) in which the EST signal 2 is in an ON state. A dwell period refers to the width of a current supply pulse or the amount of time that a coil circuit supplies current to a coil of a spark plug.

Current to the coil circuit may be activated and supplied based on the rising edge of the current supply pulse. Current to the coil circuit may be deactivated and may not be supplied based on the falling edge of the current supply pulse and/or based on a spark time. Secondary voltage of a coil circuit may increase until a spark occurs across electrodes of the spark plug. This is shown by current ramps 7 of the coil current signal 4. Current in the coil circuit is used to generate the spark. The spark time may occur at the same time as the falling edge of the current supply pulse, for example at falling edges 8.

Amplitude or current level of the coil current signal increases with an increase in dwell period when a supply voltage is constant. An example of this is shown in FIG. 1, where current level $C_2$ is greater than current level $C_1$ since dwell period $D_2$ is greater than dwell period $D_1$. Current levels $C_2$ and $C_1$ correspond respectively to dwell periods $D_2$ and $D_1$.

Figure 2:
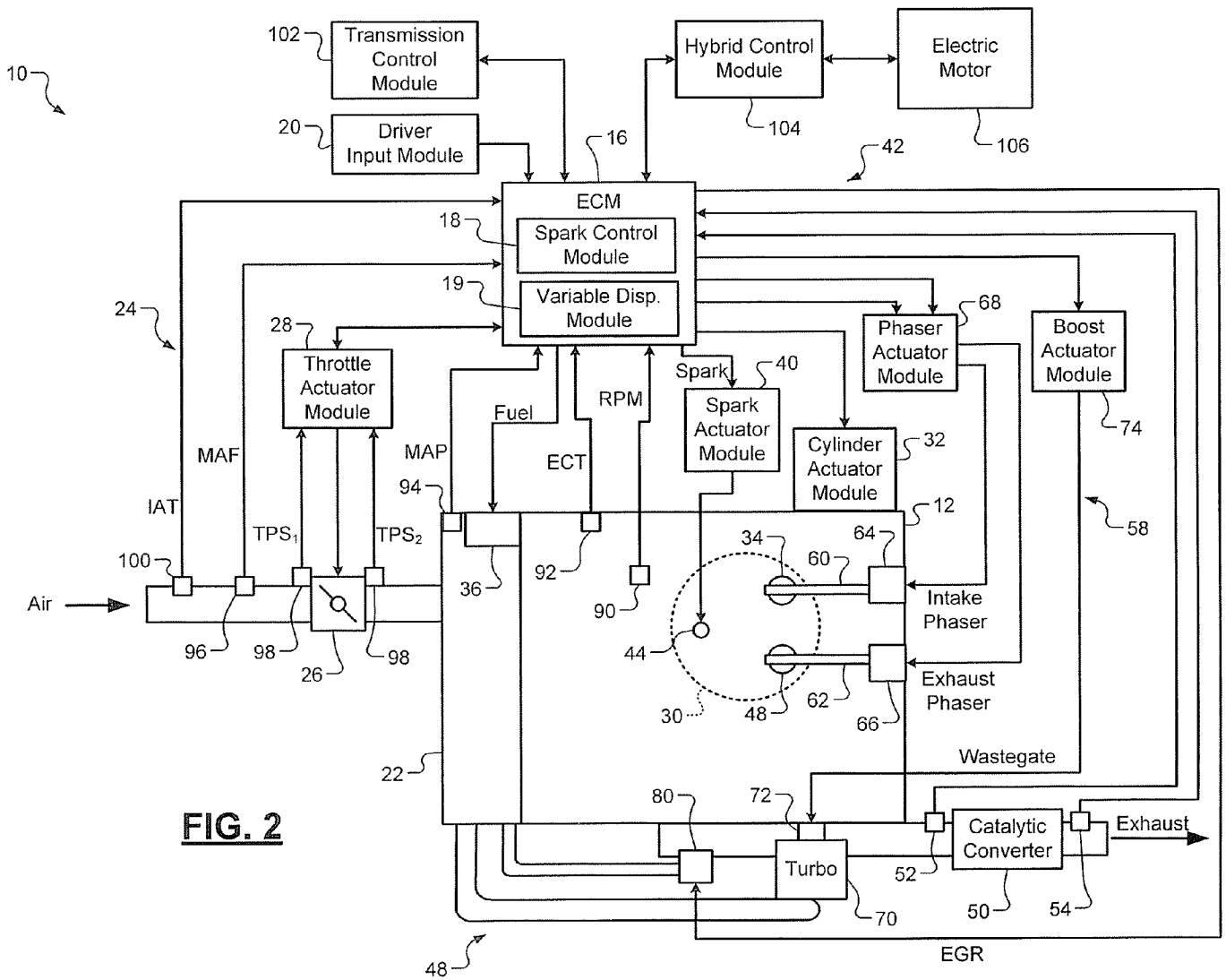
FIG. 2 is a functional block diagram of a portion of an engine control system in accordance with an embodiment of the present disclosure.

In FIG. 2, a first portion 10 of an engine control system is shown. The engine control system includes an engine 12 and an engine control module (ECM) 16. The ECM 16 includes a spark control module 18 and a variable displacement module 19, which operate in a fuel management (FM) mode and an active cylinder mode. One or more cylinders of the engine 12 are deactivated during the FM mode. The deactivation of a cylinder may include the deactivation of fuel to that cylinder and the maintaining of intake and exhaust valves of that cylinder in a closed state. The active cylinder mode refers to when the FM mode is deactivated. The spark control and variable displacement modules 18, 19 limit dwell time to limit secondary voltage across electrodes of spark plugs during the FM mode.

The engine 12 combusts an air/fuel mixture to produce drive torque for a vehicle based on a driver input module 20. Air is drawn into an intake manifold 22 of a throttle control system 24 of the engine 12 through a throttle valve 26. The ECM 16 commands a throttle actuator module 28 to regulate opening of the throttle valve 26 to control the amount of air drawn into the intake manifold 22. Air from the intake manifold 22 is drawn into cylinders of the engine 12. While the engine 12 may include multiple cylinders, for illustration purposes, a single representative cylinder 30 is shown.

The ECM 16 via the variable displacement module may instruct a cylinder actuator module 32 to selectively deactivate some of the cylinders to improve fuel economy. The cylinders may be deactivated during light load conditions. Light load conditions may include when the driver pedal is within a predetermined range and/or at a position that is less than a predetermined position, the throttle is within a predetermined range and/or at a position that is less than a predetermined position, air per cylinder is within a predetermined range, torque output of the engine 12 is within a predetermined range and/or less than a predetermined output torque, etc.

Air from the intake manifold 22 is drawn into the cylinder 30 through an intake valve 34. The ECM 16 controls the amount of fuel injected by a fuel injection system 36. The fuel injection system 36 may inject fuel into the intake manifold 22 at a central location or may inject fuel into the intake manifold 22 at multiple locations, such as near the intake valve of each of the cylinders. Alternatively, the fuel injection system 36 may inject fuel directly into the cylinders.

The injected fuel mixes with the air and creates the air/fuel mixture in the cylinder 30. A piston (not shown) within the cylinder 30 compresses the air/fuel mixture. Based upon a signal from the ECM 16, a spark actuator module 40 of an ignition system 42 energizes a spark plug 44 in the cylinder 30, which ignites the air/fuel mixture. The spark actuator module 40 may be referred to as an ignition control module, as in FIG. 3. Spark timing may be specified relative to the time when the piston is at its topmost position, referred to as to top dead center (TDC), the point at which the air/fuel mixture is most compressed.

The combustion of the air/fuel mixture drives the piston down, thereby driving a rotating crankshaft (not shown). The piston then begins moving up again and expels the byproducts of combustion through an exhaust valve 48. The byproducts of combustion are exhausted from the vehicle via an exhaust system 48.

The exhaust system 48 includes a catalytic converter 50, a pre-converter (primary) $O_2$ sensor 52, and a post-converter (secondary) $O_2$ sensor 54. The pre-converter $O_2$ sensor 52 is located upstream (with respect to the exhaust) of the catalytic converter 50 between the exhaust manifold and the catalytic converter. The post-converter $O_2$ sensor 54 is located downstream of the catalytic converter 50.

The catalytic converter 50 controls emissions by increasing the rate of oxidization of hydrocarbons (HC) and carbon monoxide (CO) and the rate of reduction of nitrogen oxides ($NO_x$). To enable oxidization, the catalytic converter 50 requires $O_2$. The $O_2$ storage capacity of the catalytic converter 50 is indicative of catalytic converter efficiency in oxidizing the HC and CO and catalytic converter ability in reducing $NO_x$.

The pre-converter $O_2$ sensor 52 communicates with the ECM 16 and measures the $O_2$ content of the exhaust stream entering the catalytic converter 50. The post-converter $O_2$ sensor 54 communicates with the ECM 16 and measures the $O_2$ content of the exhaust stream exiting the catalytic converter 50. The primary and secondary $O_2$ signals are indicative of $O_2$ levels in the exhaust system 48 before and after the catalytic converter 50. The $O_2$ sensors 52, 54 generate the respective primary and secondary $O_2$ signals that are fedback to the ECM 16 for closed loop control of air/fuel ratio(s).

The intake and exhaust valves 34, 48 may be controlled via a valve control system 58, which may include intake and exhaust camshafts 60, 62. In various implementations, multiple intake camshafts may control multiple intake valves per cylinder and/or may control the intake valves of multiple banks of cylinders. Similarly, multiple exhaust camshafts may control multiple exhaust valves per cylinder and/or may control exhaust valves for multiple banks of cylinders. In an alternative embodiment, positioning of the intake and exhaust valves of each cylinder may be individually and independently controlled via dedicated valve actuators (not shown). The cylinder actuator module 32 may deactivate cylinders by halting provision of fuel and by disabling respective exhaust and/or intake valves.

The time at which the intake valve 34 is opened may be varied with respect to piston TDC by an intake cam phaser 64. The time at which the exhaust valve 48 is opened may be varied with respect to piston TDC by an exhaust cam phaser 66. A phaser actuator module 68 controls the phasers 64, 66 based on signals from the ECM 16.

The engine control system may include a boost device that provides pressurized air to the intake manifold 22. For example, FIG. 1 depicts a turbocharger 70. The turbocharger 70 is powered by exhaust gases flowing through the exhaust system 48, and provides a compressed air charge to the intake manifold 22. The air used to produce the compressed air charge may be taken from the intake manifold 22.

A wastegate 72 may allow exhaust gas to bypass the turbocharger 70, thereby reducing the turbocharger's output (or boost). The ECM 16 controls the turbocharger 70 via a boost actuator module 74. The boost actuator module 74 may modulate the boost of the turbocharger 70 by controlling the position of the wastegate 72. The compressed air charge is provided to the intake manifold 22 by the turbocharger 70. An intercooler (not shown) may dissipate some of the compressed air charge's heat, which is generated when air is compressed and may also be increased by proximity to the exhaust system 48. Alternate engine systems may include a supercharger that provides compressed air to the intake manifold 22 and is driven by the crankshaft.

The engine control system may include an exhaust gas recirculation (EGR) valve 80, which selectively redirects exhaust gas back to the intake manifold 22. In various implementations, the EGR valve 80 may be located after the turbocharger 70. The engine control system may measure the speed of the crankshaft in revolutions per minute (RPM) using an RPM sensor 90. The temperature of the engine coolant may be measured using an engine coolant temperature (ECT) sensor 92. The ECT sensor 92 may be located within the engine 12 or at other locations where the coolant is circulated, such as a radiator (not shown).

The pressure within the intake manifold 22 may be measured using a manifold absolute pressure (MAP) sensor 94. In various implementations, engine vacuum may be measured, where engine vacuum is the difference between ambient air pressure and the pressure within the intake manifold 22. The mass of air flowing into the intake manifold 22 may be measured using a mass air flow (MAF) sensor 96. In various implementations, the MAF sensor 96 may be located in a housing with the throttle valve 26.

The throttle actuator module 28 may monitor the position of the throttle valve 26 using one or more throttle position sensors (TPS) 98. The ambient temperature of air being drawn into the engine control system may be measured using an intake air temperature (IAT) sensor 100. The ECM 16 may use signals from the sensors to make control decisions for the engine control system.

The ECM 16 may communicate with a transmission control module 102 to coordinate shifting gears in a transmission (not shown). For example, the ECM 16 may reduce torque during a gear shift. The ECM 16 may communicate with a hybrid control module 104 to coordinate operation of the engine 12 and an electric motor 106. The electric motor 106 may also function as a generator, and may be used to produce electrical energy for use by vehicle electrical systems and/or for storage in a battery. In various implementations, the ECM 16, the transmission control module 102, and the hybrid control module 104 may be integrated into one or more modules.

To abstractly refer to the various control mechanisms of the engine 12, each system that varies an engine parameter may be referred to as an actuator. For example, the throttle actuator module 28 can change the blade position, and therefore the opening area, of the throttle valve 26. The throttle actuator module 28 can therefore be referred to as an actuator, and the throttle opening area can be referred to as an actuator position.

Similarly, the spark actuator module 40 can be referred to as an actuator, while the corresponding actuator position is amount of spark advance. Other actuators include the boost actuator module 74, the EGR valve 80, the phaser actuator module 68, the fuel injection system 36, and the cylinder actuator module 32. The term actuator position with respect to these actuators may correspond to boost pressure, EGR valve opening, intake and exhaust cam phaser angles, air/fuel ratio, and number of cylinders activated, respectively.

Figure 3:
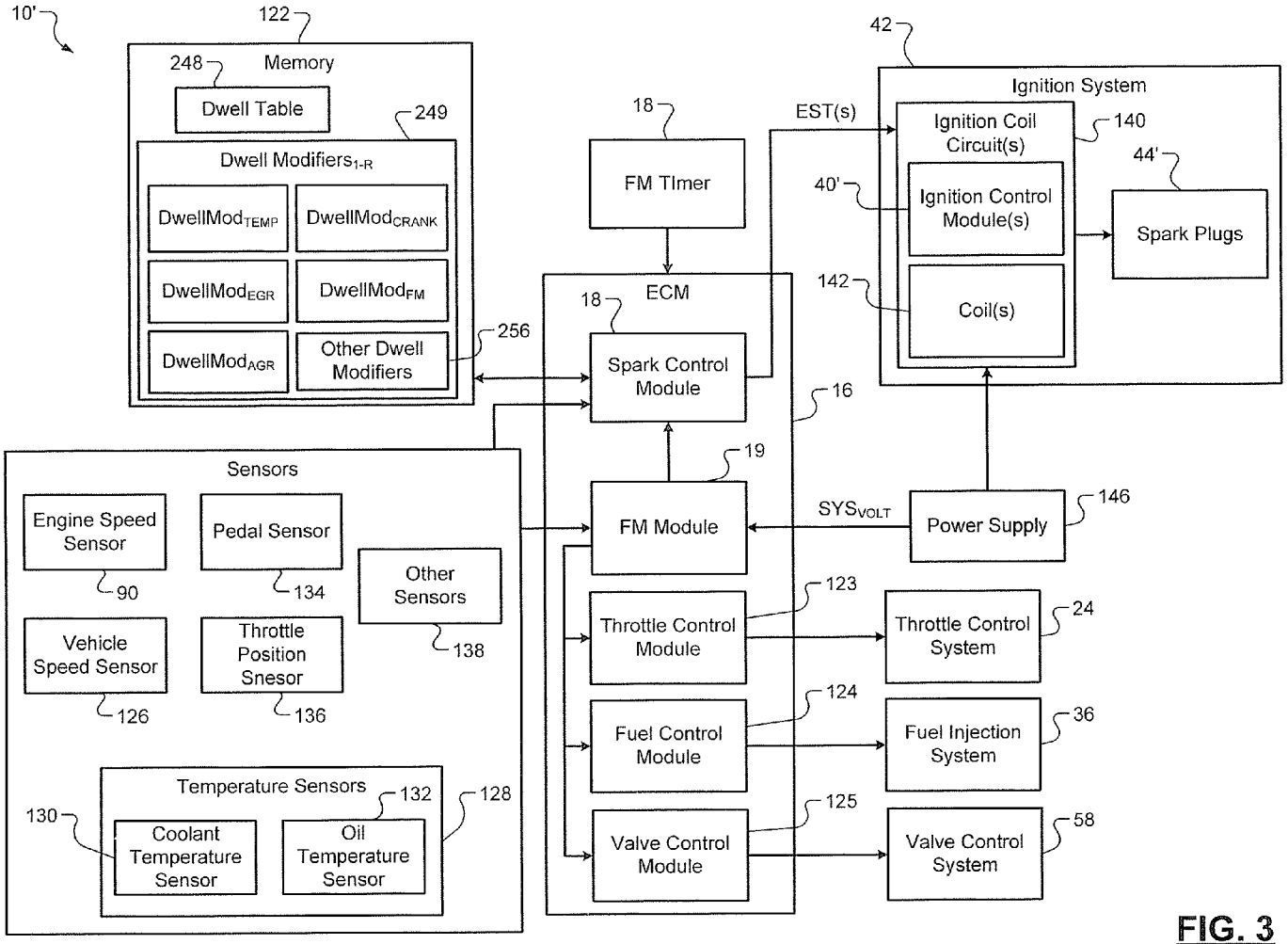
FIG. 3 is a functional block diagram of another portion of the engine control system of FIG. 1 in accordance with an embodiment of the present disclosure.

Referring now also to FIG. 3, a second portion 10' of the engine control system is shown. The second portion 10' includes the ECM 16, the throttle control system 24, the fuel injection system 36, the ignition system 42, and the valve control system 58. The ECM 16 includes the spark control module 18 and the variable displacement module 19, which may communicate with the systems 24, 36, 42, 58 sensors 120, memory 122 and a FM timer 124. The ECM 16 also includes a throttle control module 123, a fuel control module 124 and a valve control module 125 that communicate respectively with the throttle control system 24, the fuel injection system 36 and the valve control system 58.

The sensors 120 may include the engine speed sensor 90 and/or a vehicle speed sensor 126. The sensors 120 may also include temperature sensors 128, such as a coolant temperature sensor 130 and an oil temperature sensor 132. The sensors 120 may further include a driver (accelerator) pedal sensor 134 and/or a throttle position sensor 136 and other sensors 138, such as the sensors mentioned above with respect to FIG. 2.

The ignition system 42 may include ignition coil circuit(s) 140 with respective ignition control module(s) 40', coil(s) 142 and spark plugs 44'. An ignition coil circuit may be provided for each spark plug or a single ignition control circuit may be provided for multiple spark plugs. The ignition coil circuits 140 may receive current from a power supply 146, such as a battery or battery pack, and supply the current to coils 142. The ignition control module(s) 40' may each include an ASIC, which controls current to the coil(s) and spark timing based on an EST signal from the spark control module 18.

Figure 4A:
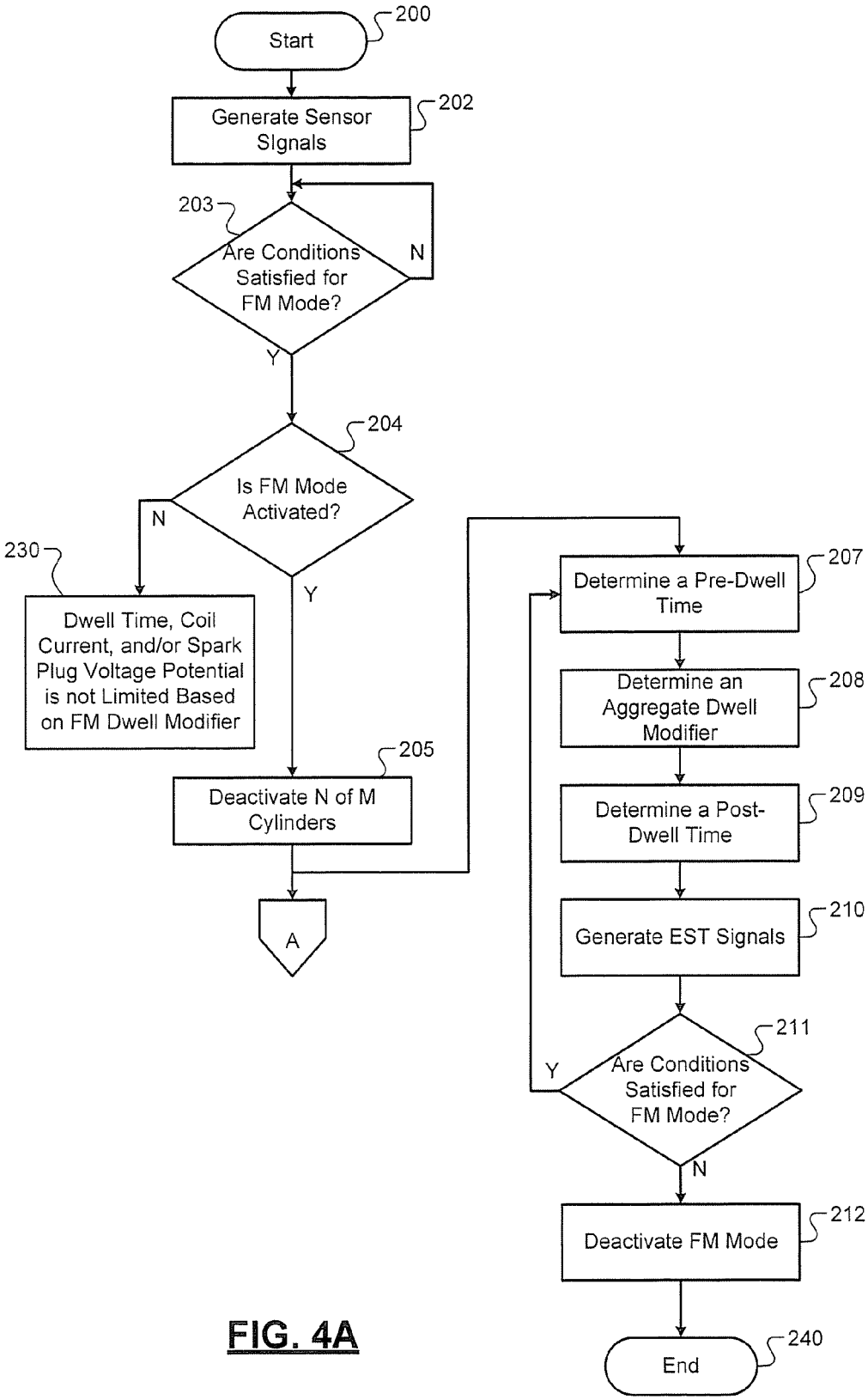
FIG. 4A is a logic flow diagram illustrating a method of operating an engine control system in accordance with an embodiment of the present disclosure.
Figure 4B:
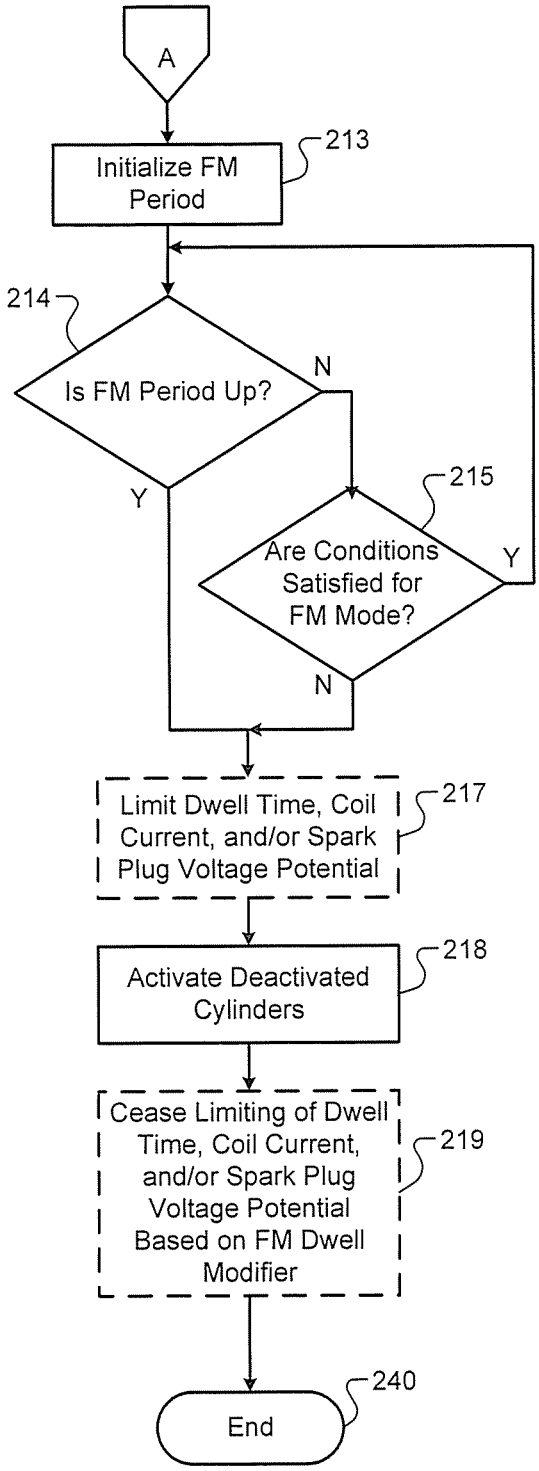
FIG. 4B is a continuation of the logic flow diagram of FIG. 4A.

Referring now also to FIGS. 4A and 4B, a logic flow diagram illustrating a method of operating an engine control system including limiting voltage across electrodes of spark plugs of an engine is shown. Although the following steps are primarily described with respect to the embodiments of FIGS. 2-3, the steps may be easily modified to apply to other embodiments of the present invention. The method may begin at step 200.

In step 202, sensor signals are generated and received by the spark control module 18 and the variable displacement module 19. The sensor signals may include, for example, a vehicle speed signal, an engine speed signal, a temperature signal, and a driver pedal and/or throttle position signal that are generated by the sensors 120. In step 203, the sensor signals are monitored and step 204 is performed when conditions are satisfied for the FM mode. For example, step 204 may be performed when engine load, air per cylinder, driver pedal position, and/or throttle position are within respective predetermined ranges.

In step 204, the variable displacement module 19 activates the FM mode based on the sensor signals. Step 205 is performed when the FM mode is activated. Step 230 is performed when the FM mode is not activated.

In step 205, the variable displacement module 19 may deactivate N of M cylinders of the engine 12 during the FM mode based on, for example, engine load. N is an integer and M is an integer greater than 1. M−N of the cylinders are maintained in an active state during the FM mode. Fuel to the N cylinders is deactivated. Intake and exhaust valves of the N cylinders are maintained in a closed state.

Steps 207-212 or steps 213-219 may be performed after step 205. Steps 207-212 may be associated with a first embodiment. Steps 213-219 may be associated with a second embodiment. Steps 213-219 may be performed as an alternative to steps 207-212.

In step 207, the spark control module 18 determines a pre-dwell time $DwellTime_{PRE}$. The pre-dwell time $DwellTime_{PRE}$ may refer to a dwell time that is determined via a dwell look-up table 248 and based on a system voltage $SYS_{VOLT}$, a vehicle speed $RPM_{VEH}$ and/or an engine speed $RPM_{ENG}$. The system voltage $SYS_{VOLT}$ may be based on voltage from the power supply 146 or voltage of a system bus (not shown). The vehicle speed $RPM_{VEH}$ and engine speed $RPM_{ENG}$ may be determined based on signals from the vehicle speed and engine speed sensors 90 and 126.

For a given system voltage, an increase in dwell time increases current supplied to a spark plug coil and secondary voltage across electrodes and/or element of a spark plug. For a given dwell time, an increase in system voltage increases current supplied to a spark plug coil and secondary voltage across electrodes and/or element of a spark plug. The pre-dwell time $DwellTime_{PRE}$ may also be based on other parameters, such as temperature. See, for example, equation 1, where RPM is engine or vehicle speed and TEMP is temperature.

$$DwellTime_{PRE}=f\{SYS_{VOLT},RPM,TEMP\} \quad (1)$$

Figure 5:
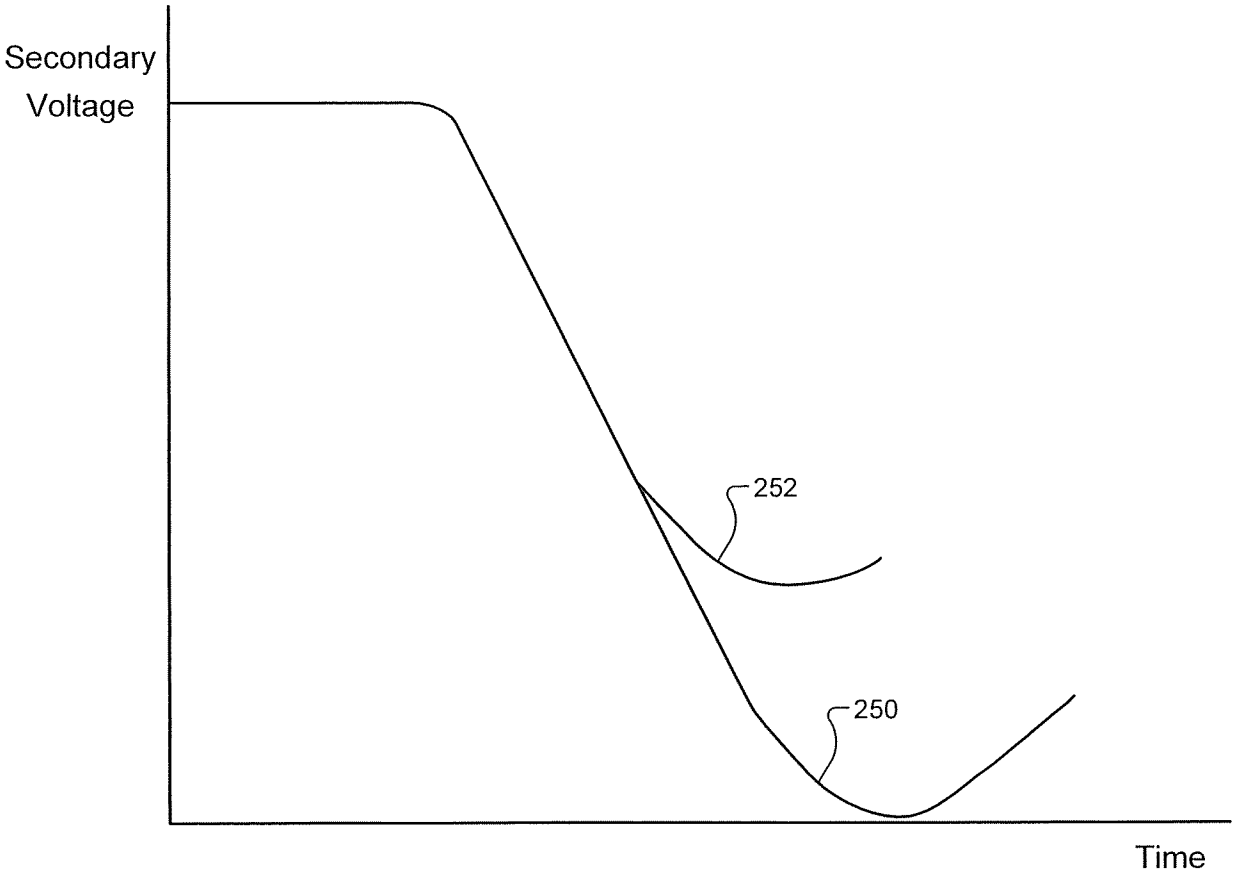
FIG. 5 is an exemplary plot of coil current signals with respective dwell modifiers in accordance with an embodiment of the present disclosure.

In step 208, the spark control module 18 determines an aggregate dwell modifier $DwellMod_{AGR}$, which refers to an aggregate of multiple dwell modifiers 249. Dwell modifiers are used to adjust the length of a dwell period of an EST signal. In FIG. 5, a plot of two coil secondary voltage signals is shown. The first coil secondary voltage signal 250 is associated with the active cylinder mode and the second coil secondary voltage signal 252 is associated with the FM mode (cylinder deactivation mode). For the same system voltage, the dwell period associated with the second coil secondary voltage signal 252 is less than the dwell period associated with the first coil secondary voltage signal 250. The reduced dwell period limits the current supplied to a coil circuit and thereby limits the secondary voltage that can be created across electrodes and/or elements of a spark plug.

The aggregate dwell modifier $DwellMod_{AGR}$ may be generated based on a FM dwell modifier $DwellMod_{FM}$ during the FM mode to reduce length of EST dwell periods. Limiting secondary voltage across electrodes and/or elements of a spark plug prevents damage to electrode insulator(s) of the spark plug.

The aggregate dwell modifier $DwellMod_{AGR}$ may be determined such that the available potential at the electrodes of a spark plug exceeds a potential needed for a spark. The secondary voltage needed for a spark is based on air/fuel ratio of a cylinder, gap between spark plug electrodes, spark timing, engine compression ratio, etc. The secondary voltage that can be created is directly related to dwell time. Overshooting required dwell time or increasing dwell time to provide this increased secondary voltage prevents misfires.

For example, during a lean operating mode and/or during cranking of the engine, a high secondary voltage 25-30 kV may be needed to provide a spark across electrodes of a spark plug. The dwell time may be set to allow for 30-40 kV. This high secondary voltage of 30-40 kV may cause damage to electrode insulator(s) of a spark plug during the FM mode due to oil build up between the electrodes. The dwell time and secondary voltage are limited to prevent this damage from occurring. In one embodiment, the secondary voltage is limited to less than or equal to 30 kV or a predetermined secondary voltage that is a less than a spark plug dielectric strength voltage (e.g. 33 kV). In another embodiment, current levels of the coil(s) 142 is limited to a predetermined current level, which may be associated with a secondary voltage that is less than a spark plug dielectric strength voltage. Coil current levels may be limited without adjustment in and independent of dwell periods via current limit circuits (not shown) including in the ignition coil circuits 140.

During the FM mode, the secondary voltage may be limited to the predetermined secondary voltage. Since engine load is low during the FM mode, the secondary voltage needed to provide a spark is low (e.g. 6 kV-18 kV). Limiting the secondary voltage to a predetermined secondary voltage (e.g. 30 kV) that is greater than that needed for spark (e.g. 6 kV-18 kV) and less than a spark plug dielectric strength voltage (e.g. 33 kV) allows for air/fuel mixture ignition and prevents misfiring and damage to spark plug insulative elements.

The aggregate dwell modifier $DwellMod_{AGR}$ may be determined using, for example, one of equations 2-4. In equation 2, R is the number of dwell modifiers. $DwellMod_{TEMP}$ refers to a dwell modifier that is determined based on temperature. $DwellMod_{EGR}$ refers to a dwell modifier that is determined based on state of an EGR valve, an EGR system, and/or flow through an EGR valve. $DwellMod_{CRANK}$ refers to a dwell modifier that is determined during cranking, startup, and/or a cold start of the engine. $DwellMod_{FM}$ refers to a dwell modifier that is determined for the fuel management mode. $DwellMod_{FM}$ may be a value between 0 and 1 and used to decrease length of a dwell period of an EST signal. Other dwell modifiers 256 may be used. The dwell modifiers$_{1-R}$ may be stored in the memory 122.

$$DwellMod_{AGR} = \sum_{I=1}^{R} DwellMod_I \quad (2)$$

$$DwellMod_{AGR} = DwellMod_{TEMP} \cdot DwellMod_{EGR} \cdot DwellMod_{CRANK} \cdot DwellMod_{FM} \quad (3)$$

$$DwellMod_{AGR} = DwellMod_{TEMP} + DwellMod_{EGR} + DwellMod_{CRANK} + DwellMod_{FM} \quad (4)$$

In step 209, the spark control module 18 determines a post-dwell time $DwellTime_{POST}$, for example, using equation 5. The spark control module 18 reduces dwell time of the N cylinders during the FM mode based on the aggregate dwell modifier $DwellMod_{AGR}$, which is based on the FM dwell modifier $DwellMod_{FM}$.

$$DwellTime_{POST}=DwellTime_{PRE} \cdot DwellMod_{AGR} \quad (5)$$

In one embodiment, a single aggregate dwell modifier $DwellMod_{AGR}$ and/or a single FM dwell modifier $DwellMod_{FM}$ may be determined for the cylinders of the engine 12. In an alternative embodiment, a first aggregate dwell modifier $DwellMod_{AGR}$ and/or a first FM dwell modifier $DwellMod_{FM}$ are determined for the activated cylinders of the engine 12. A second aggregate dwell modifier $DwellMod_{AGR}$ and/or a second FM dwell modifier $DwellMod_{FM}$ are determined for the deactivated cylinders of the engine 12. In yet another embodiment, an aggregate dwell modifier $DwellMod_{AGR}$ and/or a FM dwell modifier $DwellMod_{FM}$ are determined for each of the cylinders of the engine 12.

In step 210, the spark control module 18 generates EST signals for respective spark plugs of the M cylinders. The EST signals are generated based on respective post-dwell times. The EST signals are provided to the respective ignition coil circuits, which provide current to the spark plug coils based on the post-dwell times.

An EST signal may be generated for each of the spark plugs (activated and deactivated). In a first embodiment, the EST signals for the M cylinders are generated based on post-dwell times. The post-dwell times may be generated based on respective pre-dwell times and FM dwell modifiers during the FM mode. In a second embodiment, the EST signals for the N cylinders are generated based on the post-dwell times. In the second embodiment, the EST signals for the M−N cylinders or the active cylinders are generated based on the pre-dwell times and are not generated based on the FM dwell modifiers.

In step 211, the sensor signals are monitored and step 212 is performed when conditions are not satisfied for the FM mode. In step 212, the variable displacement module 219 may deactivate the FM mode based on, for example, engine load, air per cylinder, driver pedal position, and/or throttle position. Fuel and intake and exhaust valves are activated for the N deactivated cylinders. Dwell time, current to spark plug coils, and/or secondary voltage of spark plugs is not limited based on a FM dwell modifier.

In step 213, an FM timer is initialized. The FM timer may be used to limit the amount of time that the engine control system operates in the FM mode to a predetermined period or FM period. This minimizes oil build up in deactivated cylinders. The FM period may be associated with a maximum coil current and/or a maximum potential between spark plug electrodes and/or elements. In step 214, when the FM timer exceeds the FM period, the variable displacement module 19 proceeds to step 215, otherwise to step 217.

In step 215, the sensor signals are monitored and step 217 is performed when conditions are not satisfied for the FM mode, otherwise step 214 is performed. In step 217, dwell time, current to spark plug coils, and/or secondary voltage of spark plugs may be limited as described in step 207-209.

In step 218, the N deactivated cylinders are activated including the activation of fuel and operation of intake and exhaust valves. Fuel is activated after a predetermined number of combustion cycles. In a 4-stroke engine, a combustion cycle may include an intake stroke, a compression stroke, an ignition stroke and an exhaust stroke. Exhaust valves may be opened before activation of fuel to allow purging of contents of the N deactivated cylinders. This allows oil build up in the deactivated cylinders to be removed before activation of fuel.

In step 219, the spark control module 18 may cease limiting of the dwell time, current to spark plug coils, and/or secondary voltage of spark plugs based on the fuel management (FM) dwell modifier. Dwell time of the M cylinders may be determined and is not based on a FM dwell modifier. Step 218 may be performed while step 217 is performed.

The method may end at 240 after steps 212, 219 and 230. The above-described steps are meant to be illustrative examples; the steps may be performed sequentially, synchronously, simultaneously, continuously, during overlapping time periods or in a different order depending upon the application.

The above-described embodiments protect structural integrity of spark plugs and reduce oil consumption. By protecting structural integrity of the spark plug, sparkplug life is increased and damage to cylinder walls is prevented.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An engine control system for a vehicle comprising:

a variable displacement module that deactivates N of M cylinders of an engine during a fuel management mode, where N is an integer and M is an integer greater than 1; and a spark control module that generates a spark timing signal for the N cylinders based on a pre-dwell time and a fuel management dwell modifier during the fuel management mode, wherein the spark control module reduces dwell time of the N cylinders during the fuel management mode based on the fuel management dwell modifier.

2. The engine control system of claim 1, wherein the spark control module generates the pre-dwell time based on system voltage and at least one of engine speed and vehicle speed.

3. The engine control system of claim 2, wherein the system voltage is voltage of a power supply of the vehicle.

4. The engine control system of claim 2, wherein the spark control module generates the pre-dwell time based on engine speed.

5. The engine control system of claim 1, wherein the variable displacement module deactivates fuel supplied to the N cylinders and maintains intake valves and exhaust valves in a closed state during the fuel management mode.

6. The engine control system of claim 1, wherein the spark control module adjusts the fuel management dwell modifier based on engine load.

7. The engine control system of claim 6, wherein the spark control module determines the engine load based on at least one of throttle position and air per cylinder.

8. The engine control system of claim 1, wherein the spark control module adjusts spark timing of the M cylinders based on the fuel management dwell modifier during the fuel management mode.

9. The engine control system of claim 1, wherein the variable displacement module limits time that the engine control system is operating in the fuel management mode to a predetermined period.

10. The engine control system of claim 1, further comprising an ignition coil circuit that limits current level of a coil of a spark plug of the N cylinders during the fuel management mode based on the fuel management dwell modifier.

11. An engine control system for a vehicle comprising:

a variable displacement module that deactivates N of M cylinders of an engine during a fuel management mode, where N is an integer and M is an integer greater than 1;

a spark control module that generates a spark timing signal for the N cylinders; and an ignition coil circuit that limits a current level of a coil of a spark plug of the N cylinders to a predetermined current level and a secondary voltage of the spark plug to a predetermined voltage level during the fuel management mode.

12. The engine control system of claim 11, wherein the ignition coil circuit limits the current level to the coil during dwell periods.

13. The engine control system of claim 11, wherein the ignition coil circuit limits the current level to the coil based on the spark timing signal.

14. The engine control system of claim 13, wherein the spark control module generates the spark timing signal for the N cylinders based on a pre-dwell time and a fuel management dwell modifier during the fuel management mode, wherein the spark control module reduces dwell time of the N cylinders during the fuel management mode based on the fuel management dwell modifier, and wherein the variable displacement module deactivates fuel supplied to the N cylinders and maintains intake valves and exhaust valves in a closed state during the fuel management mode.

15. The engine control system of claim 11, wherein the spark control module adjusts the fuel management dwell modifier based on engine load, and wherein the spark control module determines the engine load based on at least one of throttle position and air per cylinder.

16. The engine control system of claim 11, wherein the spark control module adjusts spark timing of the M cylinders based on the fuel management dwell modifier during the fuel management mode.

17. The engine control system of claim 11, wherein the variable displacement module limits time that the engine control system is operating in the fuel management mode to a predetermined period.

18. The engine control system of claim 1, wherein the spark control module enables spark to the N of the M cylinders during the FM mode based on the spark timing signal.

19. The engine control system of claim 1, wherein the spark control module:

determines a crank dwell modifier during cranking of the engine, an exhaust dwell modifier based on a state of an exhaust gas recirculation valve, and a temperature dwell modifier based on a temperature; and reduces the dwell time of the spark timing signal and for the N of the M cylinders based on the crank dwell modifier, the exhaust dwell modifier, and the temperature dwell modifier.

20. The engine control system of claim 11, wherein:

ignition of the N of the M cylinders is activated during the FM mode;

the spark timing signal has a dwell time for the N of the M cylinders of the engine; and the spark control module determines a fuel management dwell modifier during the fuel management mode, a crank dwell modifier during cranking of the engine, an exhaust dwell modifier based on a state of an exhaust gas recirculation valve, and a temperature dwell modifier based on a temperature, and reduces a dwell time of the spark timing signal based on the fuel management dwell modifier, the crank dwell modifier, the exhaust dwell modifier, and the temperature dwell modifier.

* * * * *